US006862783B2

(12) United States Patent
Nishikawa et al.

(10) Patent No.: US 6,862,783 B2
(45) Date of Patent: Mar. 8, 2005

(54) MANUFACTURING METHOD FOR AN INK JET RECORDING HEAD

(75) Inventors: Takao Nishikawa, Shiojiri (JP); Atsushi Takakuwa, Shiojiri (JP)

(73) Assignee: Seiko Epson Corporation (JP)

( * ) Notice: Subject to any disclaimer, the term of this patent is extended or adjusted under 35 U.S.C. 154(b) by 162 days.

(21) Appl. No.: 10/315,556

(22) Filed: Dec. 9, 2002

(65) Prior Publication Data

US 2003/0145463 A1 Aug. 7, 2003

Related U.S. Application Data

(62) Division of application No. 09/319,011, filed as application No. PCT/JP98/04419 on Sep. 30, 1998, now Pat. No. 6,523,236.

(30) Foreign Application Priority Data

Sep. 30, 1997 (JP) ..... 9-267206

(51) Int. Cl.[7] ..... H04R 17/00

(52) U.S. Cl. ..... 29/25.35; 29/890.1; 219/212.72; 219/216; 347/54; 347/68; 347/69; 347/70; 347/71; 347/72; 156/250; 156/257; 156/272

(58) Field of Search ..... 29/29.35, 890.1; 347/54, 68–72; 219/212.72, 216; 156/250, 257, 272

(56) References Cited

U.S. PATENT DOCUMENTS

| | | | | |
|---|---|---|---|---|
| 5,264,404 A | | 11/1993 | Takahama | 502/5 |
| 5,446,484 A | * | 8/1995 | Hoisington et al. | 347/68 |
| 5,530,465 A | * | 6/1996 | Hasegawa et al. | 347/70 |
| 5,612,724 A | | 3/1997 | Murakami | 347/64 |
| 5,657,539 A | | 8/1997 | Orikasa | 29/890 |
| 5,754,205 A | | 5/1998 | Miyata | 347/70 |
| 5,912,684 A | | 6/1999 | Fujii | 347/54 |
| 5,956,829 A | | 9/1999 | Kitahara | 29/25.35 |
| 6,019,458 A | * | 2/2000 | Shimada et al. | 347/70 |

FOREIGN PATENT DOCUMENTS

| | | | | |
|---|---|---|---|---|
| JP | 402028323 A | | 1/1990 | |
| JP | 2-299853 | | 12/1990 | |
| JP | 06293134 A | * | 10/1994 | B41J/2/045 |
| JP | 7-156397 | | 6/1995 | |
| JP | 9-226114 | | 9/1997 | |

OTHER PUBLICATIONS

A new device for multifunctional dosage of liquids by a free jet; Hey, N.; Freygang, M.; Gruhler, H.; Sandmaier, H.; Zengerle, R Micro Electro Mechanical Systems, Jan. 25–29, 1998; pp.: 429–431.*

Notice of Reason for Refusal, Japanese Patent Office, Patent Application No. HEI 9 (1997)–267206.

* cited by examiner

*Primary Examiner*—Paul D Kim

(74) *Attorney, Agent, or Firm*—Harness, Dickey & Pierce, P.L.C.

(57) ABSTRACT

An ink jet recording head manufacturing method is provided comprising: forming a peeling layer wherein peeling is induced by light irradiation on a base plate exhibiting light-transmissivity; forming a common electrode film on the peeling layer; forming a plurality of piezoelectric elements, forming a reservoir piece including a lid structure that accommodates one or more piezoelectric elements in an interior which forms an ink reservoir; irradiating the peeling layer with prescribed light from the base plate side to induce peeling; peeling the base plate away; and bonding a pressure chamber plate provided with a plurality of pressure chambers to the common electrode film separated from the base plate so that the pressure chambers are sealed.

9 Claims, 8 Drawing Sheets

100 INK JET PRINTER

MANUFACTURING METHOD FOR AN INK JET RECORDING HEAD

This application is a Division of application No. 09/319,011 filed May 28, 1999 now U.S. Pat. No. 6,523,236 which is a 371 of PCT/JP98/04419 filed Sep. 30, 1998.

BACKGROUND OF THE INVENTION

1. Field of the Invention

This invention relates to improvements in ink jet recording heads. More particularly, the present invention provides an ink jet recording head capable of handling higher resolutions by providing a manufacturing method involving no deterioration in production yield even when using pressure chamber plates that are thinner than conventionally.

2. Description of the Related Art

Ink jet recording heads according to the prior art comprise a pressure chamber plate, a nozzle plate bonded to one side of the pressure chamber plate, and a vibrating plate provided on the other side of the pressure chamber plate.

The pressure chamber plate is configured by forming multiple ink-holding pressure chambers on a silicon wafer, and bonding thereto a nozzle plate having nozzle holes arranged thereon corresponding to the pressure chambers (cavities). On the side of the vibrating plate opposite the pressure chambers are formed piezoelectric elements. Given this configuration, when the pressure chambers are filled with ink and a voltage is applied to the piezoelectric elements, changes are produced in the volume of the piezoelectric material, and hence changes are produced in the volumes of the pressure chambers. These changes in pressure cause ink to be discharged from the nozzle holes. In the prior art, the thickness of the silicon wafer and the height of the pressure chambers are made roughly the same.

Demand has grown in recent years, however, for higher resolution in ink jet recording heads. In order to enhance the resolution of the ink jet recording head, it is necessary to reduce both the width and height of the pressure chambers and the width of the partitioning side walls between the pressure chambers.

However, the thickness of the silicon wafers that can be used currently is on the order of 200$\mu$, which poses a limit on the height of the side walls partitioning the pressure chambers. When the thickness of the silicon wafer is made thinner than this, the mechanical strength of the silicon wafer cannot be preserved, leading to damage to the silicon wafer during the process of forming the pressure chambers and making handling otherwise problematic.

One conceivable solution is to form thinner pressure chamber plates separately from the piezoelectric elements, use a different base plate for forming the piezoelectric elements, and finally bond the pressure chamber plate and the piezoelectric elements together. When this is done, it is no longer necessary to send the pressure chamber plate through multiple process steps in order to form the piezoelectric elements, and the drawbacks of employing a thin pressure chamber plate can be eliminated.

However, because the height of the piezoelectric elements is no more than a few $\mu$, it is very difficult to peel the piezoelectric elements away from the base plate after they are formed without affecting them.

SUMMARY OF THE INVENTION

In view of the problems noted in the foregoing, a first object of the present invention is to provide an ink jet recording head capable of handling higher resolution by employing a pressure chamber plate of thin thickness.

A second object of the present invention is to provide a manufacturing method for ink jet recording heads wherewith, by forming a pressure chamber plate of thin thickness in a separate process from the piezoelectric elements, production yield is enhanced and costs are reduced.

A third object of the present invention is to provide a manufacturing method for ink jet recording heads wherewith, by unproblematically peeling away, from the base plate, the piezoelectric elements formed in a separate process from the pressure chamber plate, whereby production yield is enhanced and costs are reduced.

An invention for achieving the first object noted above is an ink jet recording head configured so that ink can be discharged by applying a voltage to piezoelectric elements, comprising: (a) a pressure chamber plate whereon are formed pressure chambers having nozzles that can discharge ink, such that the nozzles open in the same direction, (b) a common electrode film formed so as to seal the pressure chambers on a surface of the pressure chamber plate different from the surface whereon the nozzles are provided, (c) piezoelectric elements comprising piezoelectric thin films and upper electrodes, formed severally in positions corresponding to the pressure chambers on the common electrode film, and (d) a reservoir piece provided with a lid-shaped structure that accommodates in the interior thereof one or more piezoelectric elements, the interior whereof forms a reservoir.

The ink jet recording head according to the present invention is configured such that the nozzles and the pressure chambers are formed integrally by the same component or components.

An invention for achieving the second and third objects noted above is a manufacturing method for an ink jet recording head configured such that ink can be discharged from nozzles provided in pressure chambers by applying a voltage to piezoelectric elements and changing the volume thereof, comprising: (a) a peeling layer formation process for forming a peeling layer for producing peeling by the irradiation of light onto a base plate exhibiting light-transmissivity, (b) a common electrode layer formation process for forming a common electrode film on the peeling film, (c) a piezoelectric element formation process for forming a plurality of piezoelectric elements on the common electrode film, (d) a reservoir formation process for forming a reservoir piece provided with a lid-shaped structure that accommodates in the interior thereof one or more piezoelectric elements, the interior whereof forms a reservoir, (e) a peeling process for causing peeling in the peeling layer by irradiating the peeling layer from the base plate side with prescribed light, thereby peeling away the base plate, and (f) a bonding process for bonding the pressure chamber plate provided with the plurality of pressure chambers onto the common electrode film from which the base plate has been peeled, so as to seal the pressure chambers.

An invention for achieving the second and third objects noted above is a manufacturing method for an ink jet recording head configured such that ink can be discharged from nozzles provided in pressure chambers by applying a voltage to piezoelectric elements and changing the volume thereof, comprising: (a) a peeling layer formation process for forming a peeling layer for producing peeling by the irradiation of light onto a first base plate exhibiting light-transmissivity, (b) a common electrode layer formation process for forming a common electrode film on the peeling film, (c) a piezoelectric element formation process for forming a plurality of piezoelectric elements on the common electrode film, (d) an adhesive joining process for adhesively joining a second base plate, through an adhesive layer, to the surface whereon the piezoelectric elements are formed, (e) a first peeling process for causing peeling in the peeling layer by irradiating the peeling layer from the first base plate side with prescribed light, thereby peeling away the first base plate, (f) a bonding process for bonding the pressure chamber plate provided with the plurality of pressure chambers onto the common electrode film from which the first base plate has been peeled, so as to seal the pressure chambers, and (g) a second peeling process for peeling away a second base plate.

The present invention also comprises an intermediate layer formation process for forming an intermediate layer between the peeling layer and the common electrode film.

Based on the present invention, the piezoelectric element formation process comprises a process for laminating a piezoelectric layer onto the common electrode film, a process for forming an upper electrode film on the piezoelectric layer, and a process for forming piezoelectric elements by etching the laminated piezoelectric layer and upper electrode layer.

Based on the present invention, the peeling layer may be formed using a material that is either amorphous silicon, an oxide ceramic, a nitride ceramic, an organic polymer, or a metal.

Based on the present invention, the pressure chamber plate is fabricated by a process for forming a resin layer in a die, a process for peeling the resin layer away from the die, and a process for making holes in the resin layer corresponding to the nozzles.

Based on the present invention, the second peeling process causes peeling to occur at the interfaces between the adhesive layer, and the piezoelectric elements and the common electrode film.

Based on the present invention, the second peeling process causes peeling to occur in the adhesive layer.

Based on the present invention, the adhesive layer is configured so that it contains a substance that can be hardened by the application of energy.

Based on the present invention, the adhesive layer is made up of a thermoplastic resin.

Based on the present invention, an intermediate layer formation process is also comprised for forming an intermediate layer between the adhesive layer and the second base plate.

Based on the present invention, the intermediate layer is configured so as to contain one or more metals selected from among Ni, Cr, Ti, Al, Cu, Ag, Au, and Pt, and causes peeling to occur at the interface between the intermediate layer and the adhesive layer.

Based on the present invention, the intermediate layer is made either of porous silicon or an anodic oxide film, and, during the second peeling process, causes peeling to occur either in that intermediate layer or between that intermediate layer and the second base plate.

Based on the present invention, the intermediate layer is formed using a material that is either amorphous silicon, an oxide ceramic, a nitride ceramic, an organic polymer, or a metal, and, in the second peeling process, causes peeling to occur in the intermediate layer by irradiating that intermediate layer, from the second base plate side, with prescribed light.

BRIEF DESCRIPTION OF THE DRAWINGS

FIG. 3 is a set of cross-sectional views of the fabrication process for an ink jet recording head in a first embodiment, wherein

FIG. 4 is a set of cross-sectional views of the fabrication process for the ink jet recording head in the first embodiment, wherein

FIG. 5 is a set of cross-sectional views of the fabrication process for the pressure chamber plate, wherein

FIG. 6 is a set of cross-sectional views of the fabrication process for an ink jet recording head in a second embodiment, wherein

FIG. 7 is a set of cross-sectional views of the fabrication process for the ink jet recording head in the second embodiment, wherein

FIG. 9 is a pair of cross-sectional views of the fabrication process for an ink jet recording head in a third embodiment, wherein

DESCRIPTION OF THE PREFERRED EMBODIMENTS

Preferred embodiments of the present invention will now be described with reference to the drawings.

First Embodiment

A first embodiment pertains to a manufacturing method for an ink jet recording head wherein piezoelectric elements are formed on a base plate, a reservoir piece is formed on that, and the piezoelectric elements are peeled away from the base plate and bonded to an integrated pressure chamber plate fabricated separately.

(Configuration of Ink Jet Recording Head)

Figure 1:
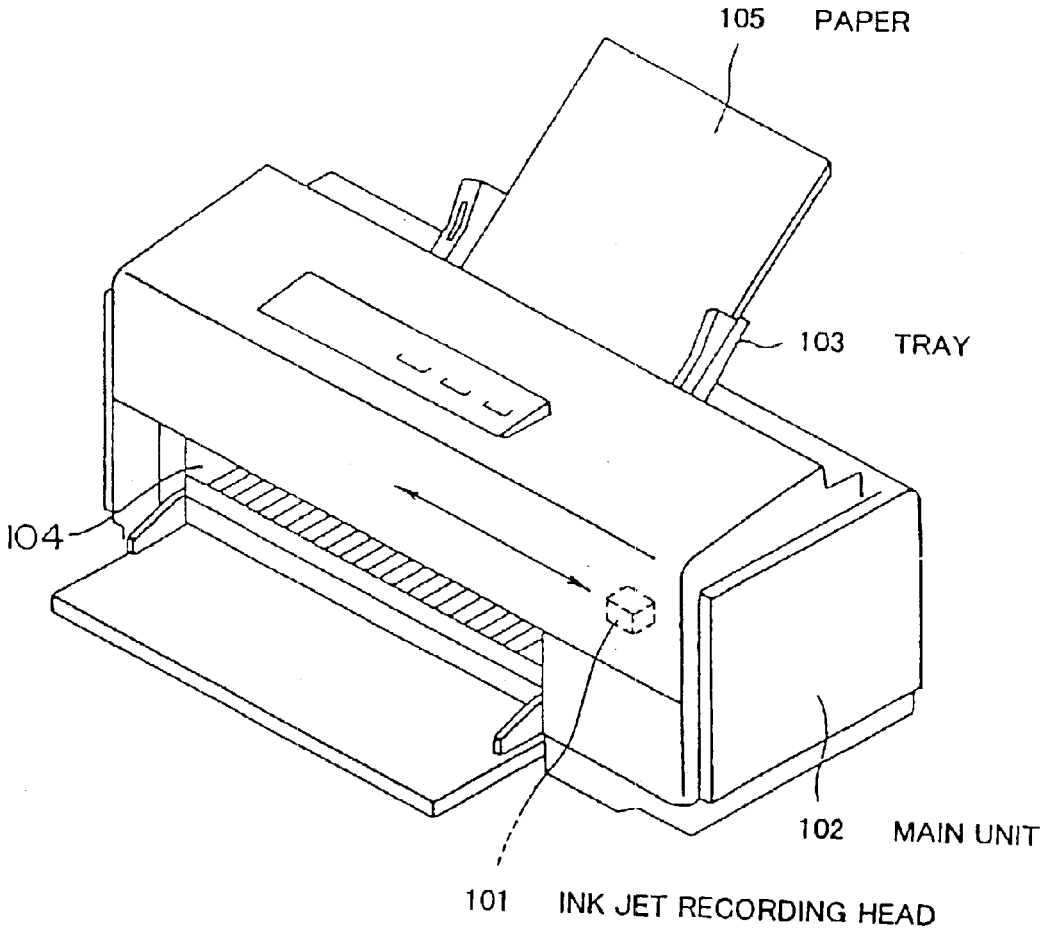
FIG. 1 is a diagonal view of an ink jet printer of the present invention.

In FIG. 1 is given a diagonal view of an ink jet printer containing an ink jet recording head fabricated by the manufacturing method of this embodiment. As depicted in FIG. 1, the ink jet printer 100 of this embodiment comprises an ink jet recording head 101 of the present invention and a tray 103 in a main unit 102. Paper 105 is placed in the tray 103. When print data are supplied from a computer (not shown), internal rollers (not shown) feed the paper 105 into the main unit 102. The ink jet recording head 101 is driven in the directions indicated by the double-headed arrow in FIG. 1 when the paper 105 passes next to the rollers, and printing is performed. After printing, the paper 105 is discharged from a discharge slot 104.

Figure 2:
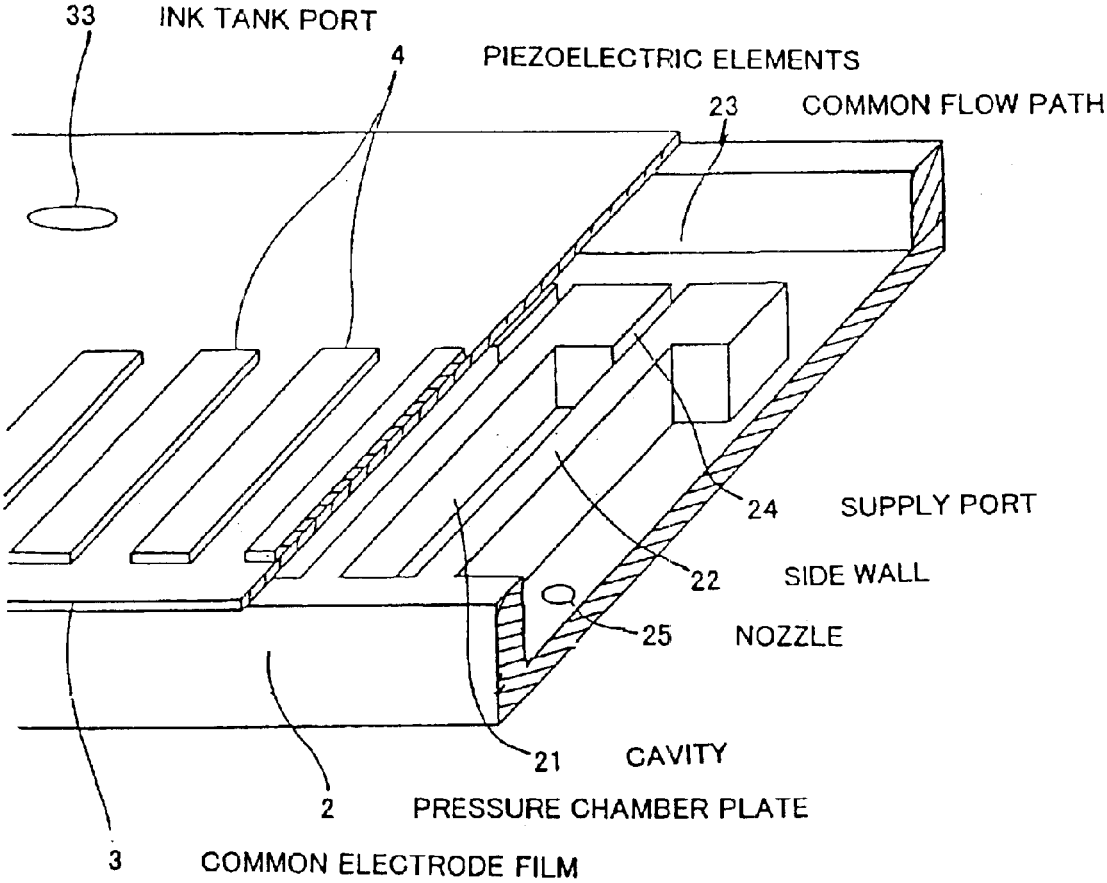
FIG. 2 is a diagonal view of the main components in an ink jet recording head of the present invention, showing a partial cross section thereof.

In FIG. 2 is given a diagonal view of the main components of the ink jet recording head noted above. A partial cross-sectional view is given here to facilitate comprehension. A general description of the structure is given here; the detailed manufacturing method will be described later. In terms of the main components of the ink jet recording head, as diagrammed in FIG. 2, a common electrode film 3 on which are formed piezoelectric elements 4 is bonded to an integrally formed pressure chamber plate 2. In FIG. 2, a reservoir piece 5 (cf. FIG. 3) is formed so as to cover the common electrode film.

In the pressure chamber plate 2 are formed a plurality of cavities 21, each of which functions as a pressure chamber. This formation is accomplished by etching a silicon monocrystalline substrate or the like. The cavities 21 are separated by side walls 22 formed therebetween. Each of the cavities 21 is connected to a common flow path 23 by a supply port 24. On one of the surfaces partitioning the cavities 21 are provided nozzles 25. A common electrode film 3 is formed of a material such as platinum and piezoelectric elements 4 are formed at positions on the common electrode film 3 corresponding to the cavities 21. An ink tank 33 is provided in the part of the common electrode film 3 that coincides with the common flow path 23.

The piezoelectric elements 4 are configured by laminating an upper electrode onto a thin piezoelectric film formed by PZT, for example.

The upper electrode of each piezoelectric element 4 is connected to the output terminal of a drive circuit (not shown), and the common electrode film 3 is connected to the ground terminal of the drive circuit.

In the configuration of the ink jet recording head described above, when the drive circuit is driven and a prescribed voltage is applied to the piezoelectric elements 4, volumetric changes are produced in the piezoelectric elements 4, whereupon the pressure on the ink in the cavities 21 rises. When the pressure on the ink rises, ink drops are discharged from the nozzles 25.

(Ink Jet Recording Head Manufacturing Method)

The ink jet recording head manufacturing method according to the present invention is described with reference to FIGS. 3–5. These figures are cross-sectional diagrams of ink jet recording head fabrication processes showing sections cut in the cavity width dimension.

Figure 3A:
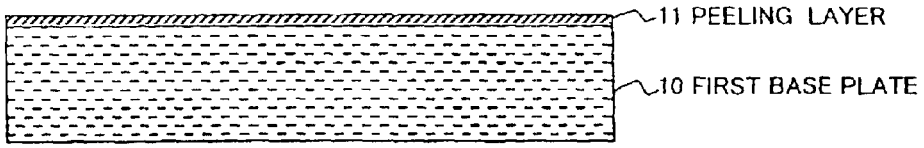
FIG. 3A represents a peeling layer formation process, FIG. 3B a common electrode film formation process, FIG. 3C a piezoelectric element formation process, and FIG. 3D an etching process.

Peeling Layer Formation Process (FIG. 3A)

In the peeling layer formation process, a peeling layer 11 for peeling away the piezoelectric elements and the common electrode film is formed on a first base plate 10 which is a temporary base plate for forming piezoelectric elements.

(First Base Plate)

The first base plate 10 may be anything that exhibits light-transmissivity capable of transmitting irradiated light and that also exhibits resistance to heat and corrosion so as to be usable in the piezoelectric element formation process. It is desirable that the irradiated light transmissivity be 10% or greater and preferably 50% or greater. If the transmissivity is too low, attenuation of the irradiated light will be too large and a greater amount of energy will be required to peel away the peeling layer.

As to heat resistance, the formation processes generate temperatures ranging from 400° C. to 900° C., for example, wherefore the material must exhibit properties capable of withstanding these temperatures. If the base plate exhibits outstanding heat resistance, then the temperature can be set freely according to the conditions for piezoelectric element formation.

If we take Tmax as the maximum temperature during the formation of the piezoelectric elements constituting the transfer layer, it is desirable that the base plate be made of a material having a distortion point that exceeds Tmax. More specifically, it is desirable that this distortion point be 350° C. or higher, and preferably 500° C. or higher. Such substances include such heat-resistance glasses as, for example, quartz glass, soda glass, Corning 7059 glass, and NEC OA-2 glass. Quartz glass is especially desirable because of its outstanding heat resistance. Whereas ordinary glass has a distortion point in the range of 400° C. to 600° C., quartz glass has a distortion point of 1000° C.

There are no serious limiting factors on the thickness of the base plate, but it should be between 0.1 mm and 0.5 mm, and preferably between 0.5 mm and 1.5 mm. If the substrate thickness is too thin, strength will be compromised, whereas, conversely, if it is too thick, attenuation will be induced in the irradiated light in cases where the base plate transmissivity is low. In cases where the base plate irradiated-light transmissivity is high, however, the thickness may be made thicker than the upper limit noted.

In order to have the irradiated light reach the peeling layer uniformly, the thickness of the base plate should be uniform.

(Peeling Layer)

The peeling layer 11 is a layer provided for producing peeling inside the layer or at the interface thereof (called "intra-layer peeling" and "interfacial peeling," respectively) when irradiated with light such as a laser beam. In other words, in the peeling layer, when light of a certain intensity is irradiated, the inter-molecular or inter-atomic bonding strength is lost or declines in the molecules or atoms making up the constituent material, resulting in ablation and causing peeling to occur. There are also cases where the irradiated light causes a gas to be released from the peeling layer which leads to peeling. In some of these cases a component contained in the peeling layer becomes a gas which is released to induce peeling, while in other cases the peeling layer absorbs the light, is gasified, and the resulting vapor is released to induce peeling.

The following compositions are conceivable for such a peeling layer.

1) Amorphous Silicon (a-Si)

This amorphous silicon may contain H (hydrogen). The hydrogen content should be 2 at % or greater, and preferably between 2 and 20 at %. When hydrogen is so contained, hydrogen is released by the light irradiation, generating internal pressure in the peeling layer and promoting peeling. The amount of this hydrogen content is adjusted according to the film forming conditions. When the CVD method is used, for example, the adjustment is made by suitably setting such conditions as gas composition, gas pressure, gas atmosphere, gas flow volume, gas temperature, substrate temperature, and the power of the light introduced.

2) Silicon Oxide or Silicate, Titanium Oxide or Titanate, Zirconium Oxide or Zirconate, Lanthanum Oxide or Lanthanate, Various Oxide Ceramics, Dielectric Substance, or Semiconductor Examples of silicon oxides include SiO, $SiO_2$, and $Si_3O_2$. Examples of silicates include $K_2Si_3$, $Li_2SiO_3$, $CaSiO_3$, $ZrSiO_4$, and $Na_2SO$.

Examples of titanium oxides include TiO, $Ti_2O_3$, and $TiO_2$. Examples of titanates include, for example, $BaTiO_4$, $BaTiO_3$, $Ba_2Ti_9O_{20}$, $BaTi_5O_{11}$, $CaTiO_3$, $SrTiO_3$, $PbTi_3$, $MgTiO_3$, $ZrTi_2$, $SnTiO_4$, $Al_2Ti_5$, and $TeTiO_3$.

An example of a zirconium oxide is $ZrO_2$. Zirconates include, for example, $BaZrO_3$, $ZrSiO_4$, $PbZrO_3$, $MgZrO_3$, and $K_2ZrO_3$.

3) Nitride Ceramics such as Silicon Nitride, Aluminum Nitride, and Titanium Nitride 4) Organic Polymer Materials The organic polymer materials may be of any composition containing bonds such as —$CH_2$—, —CO— (ketone), —CONH— (amide), —NH— (imide), —COO— (ester), —N═N— (azo), and —CH═N— (cif) (these being interatomic bonds that are severed by light irradiation), especially if such bonds are contained in abundance.

The organic polymer material may contain an aromatic hydrocarbon (either one or two or more benzene rings or condensed rings thereof). Specific examples of such organic polymers as these include polyolefins like polyethylenes and polypropylenes, polyimides, polyamides, polyesters, polymethyl methacrylate (PMMA), polyphenylene sulfide (PPS), polyether sulfone (PES), and epoxy resins.

5) Metals

Examples of metals include Al, Li, Ti, Mn, In, Sn, Y, La, Ce, Nd Pr, Gd, and Sm, as well as alloys containing at least one of these metals.

(Peeling Layer Thickness)

The thickness of the peeling layer should normally be from 1 nm to 20$\mu$, but preferably between 10 nm and 2$\mu$, and the range of 40 nm to 1$\mu$ is even more desirable. If the peeling layer thickness is too thin, thickness uniformity in the formed film will be lost, giving rise to uneven peeling. If it is too thick, the power (light intensity) of the irradiated light necessary for peeling becomes large, and more time is required to remove remnants of the peeling layer left over after peeling.

(Formation Method)

The method for forming the peeling layer may be any method capable of forming a peeling layer of uniform thickness, and so may be selected at will according to such conditions as peeling layer composition and thickness. Applicable methods include CVD (including MOCVD, low-pressure CVD, and ECR-CVD), vapor deposition, molecular beam vapor disposition (MB), sputtering, ion plating, PVD and other vapor phase film formation methods, electroplating, immersion plating, non-electrolytic plating and other plating methods, Langmuir blow-jet (LB), spin coating, spray coating, roller coating and other coating methods, any of various printing methods, transfer methods, ink jet methods, and powder jet methods, etc.

In cases where the peeling layer is amorphous silicon (a-Si), it is preferable to use CVD, and particularly low-pressure CVD or plasma CVD. In cases where the peeling layer film is formed using a ceramic material and the sol-gel method, and in cases where an organic polymer material is used, it is preferable that a coating method be used, and particularly a spin coating method.

(Intermediate Layer)

Although not depicted in the drawings, it is desirable that an intermediate layer be formed between the peeling layer 11 and the common electrode film 3. This intermediate layer performs at least one function, whether as a protective layer for physically or chemically protecting the layer being transferred during fabrication or use, insulating layer, barrier layer for blocking the migration of a component either to or from a layer being transferred, or reflecting layer.

The composition of the intermediate layer can be appropriately selected according to the purpose thereof. In the case of an intermediate layer formed between a transfer layer and a peeling layer made of amorphous silicon, for example, a silicon oxide such as $SiO_2$ may be used. Other intermediate layer compositions may contain Pt, Au, W, Ta, Mo, Al, Cr, or Ti, or an alloy containing such as the main component.

The thickness of the intermediate layer may also be suitably selected according to the purpose of its formation. Ordinarily, a thickness of 10 nm to 5$\mu$ is desirable, with a range of 40 nm to 1$\mu$ being even more preferable.

The method of forming the intermediate layer may be any of the methods noted above for the peeling layer. The intermediate layer may be made as a single layer, or, alternatively, it may be made in two or more layers having either the same composition or one using a plurality of materials.

Figure 3B:
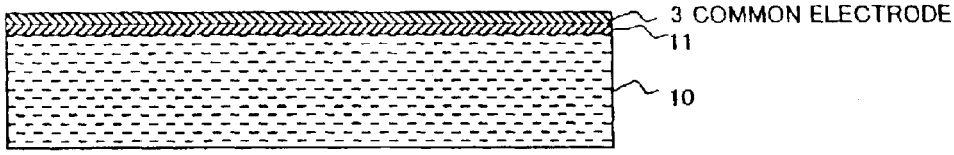

Common Electrode Film Formation Process (cf. FIG. 3B)

The common electrode film formation process is a process wherein the common electrode film 3 is formed on the peeling layer 11. The common electrode film functions as one electrode for the piezoelectric elements.

There is no particular limitation on the composition of the common electrode film 3 so long as the conductivity is high and it can withstand the temperatures encountered during piezoelectric element formation. Such metals as Pt, Au, Al, Ni, and In may be used.

For the method of forming the common electrode film 3, any method suitable to the composition and thickness thereof may be selected. This may be a sputtering method, vapor deposition method, CVD method, electroplating method, or non-electrolytic plating method, etc.

Figure 3C:
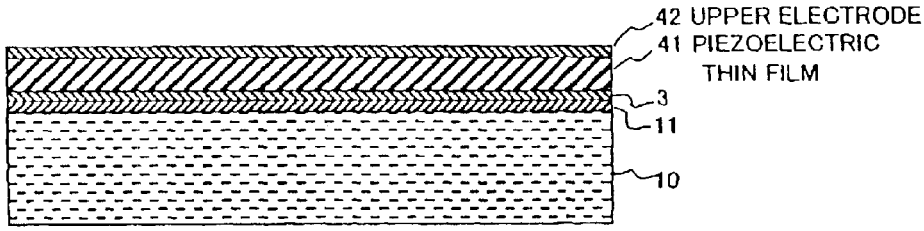

Piezoelectric Element Formation Process (cf. FIG. 3C)

The piezoelectric element formation process is a process for forming the piezoelectric thin film 41 and the upper electrode film 42 on the common electrode film 3 in the prescribed thicknesses.

For the composition of the piezoelectric thin film 41, the ferroelectric ceramics typified by lead zirconate titanate (PZT) are ideal.

The formation of the piezoelectric thin film should be by a sol-gel process. This sol-gel process is implemented by repeating a procedure, wherein a PZT-based sol made in the requisite composition is coated onto the common electrode film 3 and this is sintered, a prescribed number of times. The coating method used may be spin coating, roller coating, or die coating, etc. After repeating the prescribed number of coatings and sinterings, the whole is subjected to a final baking, whereupon a piezoelectric thin film 41 having a perovskite crystalline structure is formed. A sputtering process may be used as well as the sol-gel process.

The composition and forming method for the upper electrode film 42 are the same as for the common electrode film 3.

Figure 3D:
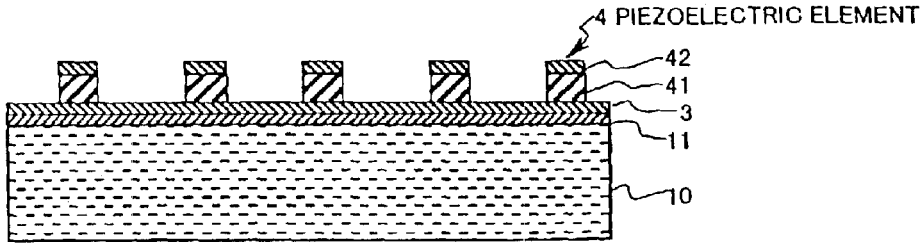

Etching Process (FIG. 3D)

In the etching process, the upper electrode film and the piezoelectric thin film are etched to form the piezoelectric elements.

Dry etching, which exhibits outstanding anisotropy, should be used as the etching method. This etching is performed after placing a resist patterned in the shape of the piezoelectric elements on the upper electrode film 42. The etching rate is adjusted by selecting suitable etching gases. Etching time is monitored, the areas of the upper electrode film 42 and piezoelectric thin film 41 where no resist is provided are removed, and the common electrode film 3 is exposed. After etching, the resist is removed by ashing it.

Figure 4E:
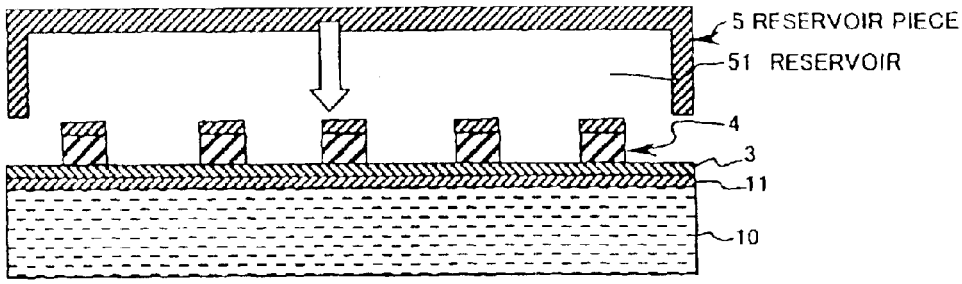
FIG. 4E represents a reservoir formation process, FIG. 4F a peeling process, and FIG. 4G a bonding process, while FIG. 4G provides a complete cross-sectional view.

Reservoir Formation Process (FIG. 4E)

In the reservoir formation process, the reservoir piece is formed so as to cover the piezoelectric elements. The reservoir piece 5 is a component having a ⊐-shaped cross-section that forms a cap, as diagrammed in FIG. 4E. In one part thereof is provided an opening (not shown) for supplying ink from an external ink tank.

The reservoir piece 5 need not be especially heat-resistant, but it does need to exhibit a certain mechanical strength and durability when exposed to ink. Hence the composition of the reservoir piece may be of any material selected from among resins, silicon, glass, or metal, etc.

Wiring for the piezoelectric elements is implemented prior to bonding the reservoir piece 5 in place. That is, the output terminal of the drive circuit (not shown) and the upper electrode 42 of each of the piezoelectric elements 4 are connected, and the ground terminal of the drive circuit and the common electrode film 3 are connected. Then the reservoir piece 5 is bonded in place so as to cover the piezoelectric elements 4. Inside the reservoir piece 5 is formed an ink reservoir 51. Any resin may be selected for bonding the reservoir piece 5.

Figure 4F:
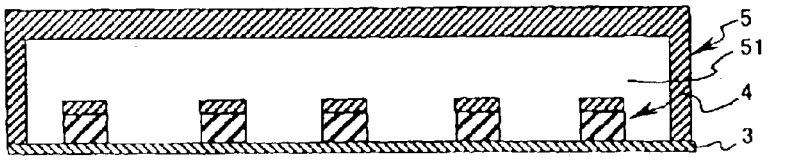

Peeling Process (FIG. 4F)

In the peeling process, light 60 is irradiated from the back side (bottom side in FIG. 4F) of the first base plate 10. This causes ablation to occur in the peeling layer 11, and the first base plate 10 is peeled away.

The kind of peeling that occurs in the peeling layer due to the irradiation of light, that is, whether intra-layer peeling or interfacial peeling, is determined by the peeling layer composition, the irradiated light, and other factors such as the type of irradiated light, wavelength, intensity, and depth of penetration.

The irradiated light may be any electromagnetic radiation, of whatever wavelength, that will cause intra-layer peeling and/or interfacial peeling in the peeling layer, such as x-rays, UV radiation, visible light, infrared radiation (heat rays), laser beam, milliwaves, or microwaves. Electron beams or nuclear radiation ($\alpha$ rays, $\beta$ rays, $\gamma$ rays) may also be used. Among these, however, laser beams are preferred because they readily cause ablation in the peeling layer.

The laser apparatus for producing such laser beams may be any type of gas laser or solid (i.e. semiconductor) laser. Excimer lasers, Nd-YAG lasers, argon lasers, $CO_2$ lasers, CO lasers, and He-Ne lasers are particularly well suited to this purpose, with the excimer laser being especially preferred. The excimer laser outputs high energy in the short wavelength region, and so is capable of producing ablation in the peeling layer in an extremely short time. Thus very little temperature rise is induced in adjacent or nearby layers, making it possible to achieve peeling while holding layer degradation and damage to a bare minimum.

When the peeling layer 11 exhibits an ablation-producing wavelength dependence, the wavelength of the irradiated laser beam should be between 100 nm and 350 nm or so. In order to produce such layer changes as gas release, vaporization, or sublimation, the wavelength of the laser beam should preferably be from 350 nm to 1200 nm or so.

The energy density of the irradiated laser beam should be in the range of 10 to 5000 mj/cm$^2$ when an excimer laser is used. The irradiation time should be 1 to 1000 nsec or so, and preferably within the range of 10 to 100 nsec. If the energy density is too low or the irradiation time is too short, adequate ablation is not produced. If the energy density is too high or the irradiation time is too long, the transfer layer may be adversely affected by irradiated light passing through the peeling layer or intermediate layer.

The light should be irradiated so that the intensity thereof is uniform. The direction of irradiation is not limited to a direction perpendicular to the peeling layer; it may be inclined at a prescribed angle to the peeling layer. In cases where the area of the peeling layer is larger than the area which can be irradiated by one irradiation, the irradiation may be divided into a number of irradiations to cover the entire area of the peeling layer. Alternatively, the same place may be irradiated a number of times. It is also permissible that the same or different areas be irradiated multiple times with light of different kinds having different wavelengths (bands).

After peeling away the first base plate 10, if there are remnants of the peeling layer on the common electrode film 3, these are removed by washing.

Figure 4G:
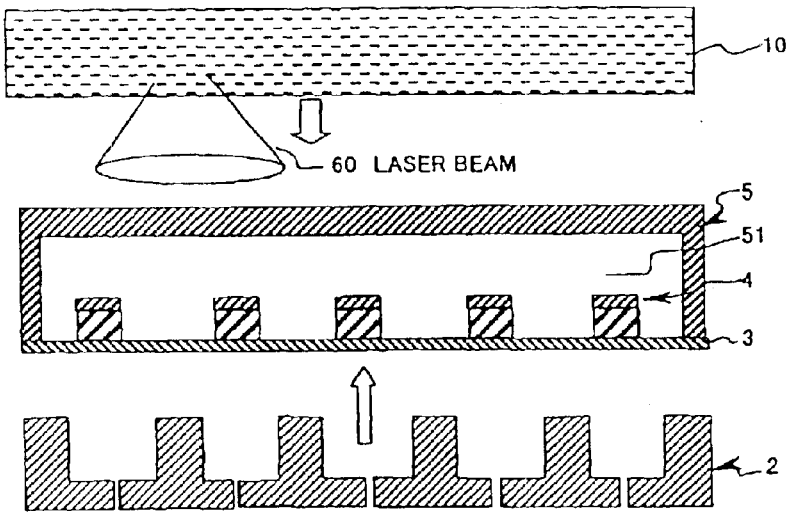
Figure 4H:
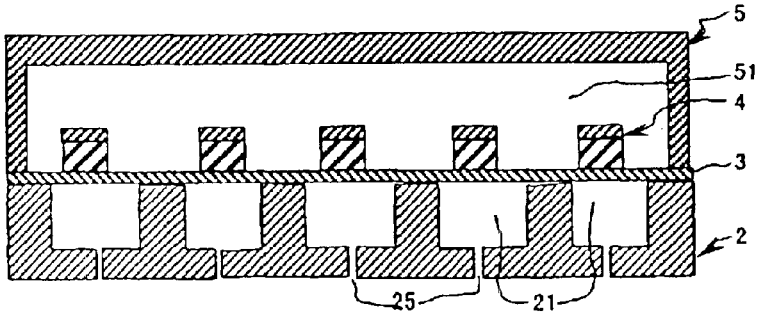

Bonding Process (FIG. 4G)

The bonding process is a process for bonding, to the common electrode film 3, a separately fabricated pressure chamber plate 2. A simple description of the method of fabricating the pressure chamber plate is now given, making reference to FIG. 5.

Master plate fabrication process (FIG. 5A): A master plate 16 is first fabricated for transferring the pressure chamber plate 2. The master plate 16 is fabricated by forming a pattern on the base material, corresponding to the cavities 21 and common flow path 23, and etching to a prescribed depth. The composition of the base material, i.e. of the master plate, may be silicon, or some other substance such as glass, quartz, resin, metal, ceramic, or film, so long as it is etchable. The resist for forming the pattern may be a positive resist comprising a cresol-novolac resin into which a diazonaphthoquinone derivative has been mixed as the photosensitive agent. This is applied as is. The resist layer is formed by spin coating, dipping, spray coating, roller coating, or bar coating.

After the light exposure, a development process is performed under prescribed conditions, whereupon the resist in the exposed areas is selectively removed. When further etching is performed in this condition, the portions corresponding to the side walls 22 are etched, resulting in a die for fabricating the pressure chamber plate 2. Either wet etching or dry etching may be selected as the etching method. This selection is made in conjunction with such conditions as the base material properties, the cross-sectional shapes that are etched, and the etching rate, etc.

After etching, the resist is removed, whereupon the master plate 16 is done.

The depth of the etching during the etching process is made equivalent to a height corresponding to the side walls 22, etc., formed on the pressure chamber plate. The height of the side walls is designed at approximately 200$\mu$ for an ink jet recording head having a resolution of 720 dpi.

Figure 5A:
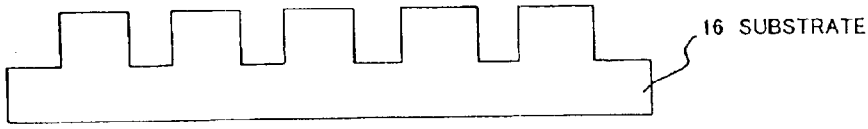
FIG. 5A represents a master plate fabrication process, FIG. 5B a base plate formation process, FIG. 5C a peeling process, and FIG. 5D a nozzle formation process.
Figure 5B:
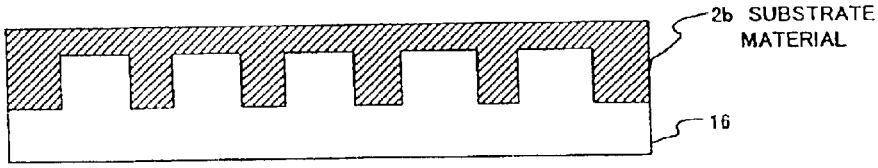

Base Plate Formation Process (FIG. 5B)

After the master plate 16 is formed, the substrate material 2*b* is coated onto the surface thereof and hardened to form the pressure chamber plate 2. There is no particular limitation on the composition of the substrate material so long as it satisfies the properties required in the ink jet pressure chamber plate in terms of mechanical strength and corrosion resistance, etc. It is nevertheless desirable that this be a material that is hardened using light, heat, or both light and heat. When such a material is used, a general purpose exposure apparatus, baking oven, or hot plate can be used in the interest of lower costs and space savings. Materials which may be used for this purpose include such synthetic resins as acrylic resins, epoxy resins, melamine resins, novolac resins, styrene resins, and polyimide resins, as well as silicon-based polymers such as a poly-silazane. If the substrate material contains a solvent component, the solvent is removed by heat treatment. Thermoplastic materials may also be used for the substrate material. One suitable material, for example, is hydrate glass having a water content of from several to several tens of wt %.

The substrate material coating method used may be spin coating, dipping, spray coating, roller coating, or bar coating, etc.

Figure 5C:
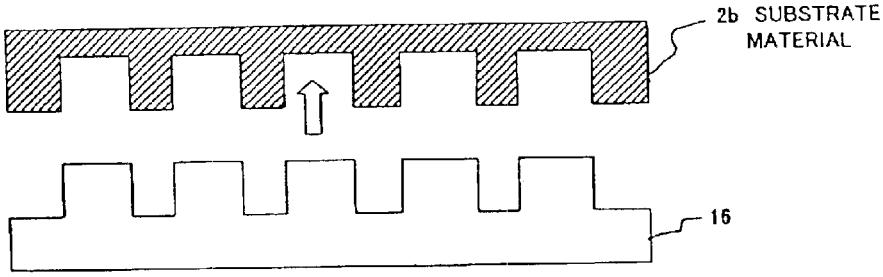

Substrate Peeling Process (FIG. 5C)

Next the hardened substrate material 2*b,* that is to say the pressure chamber plate 2, is peeled away from the master plate 16.

The peeling method used is one wherein the master plate 16 is secured, and the pressure chamber plate 2 is pulled away while being held by suction. In cases where the bonding between the master plate and the pressure chamber plate is very strong, the concave shapes in the master plate 16 should be formed beforehand with a taper. It is also permissible to irradiate the interface between the master plate and the pressure chamber plate with light prior to peeling to first lower or eliminate the bonding forces between the master plate and the pressure chamber plate. By so doing, the inter-atomic or inter-molecular bonding forces at the interface between the master plate and the pressure chamber plate are weakened or eliminated, thereby promoting the separation by the gas released from the pressure chamber plate. Light such as from an excimer laser should be used for this purpose. When light is to be irradiated, it is necessary to form the master plate 16 of a light-transmissive material. It is also preferable that a layer corresponding to the peeling layers described in the foregoing be formed at the interface between the master plate 16 and the pressure chamber plate 2. As to the specific method, those described in the foregoing may be used as described.

Figure 5D:
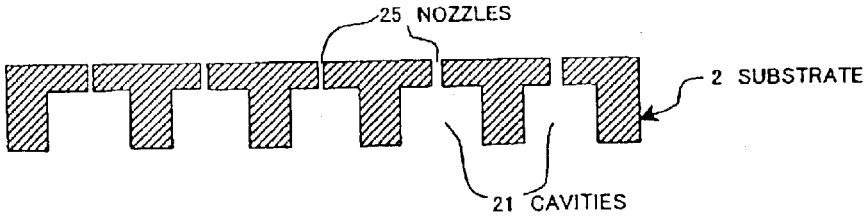

Nozzle Formation Process (FIG. 5D)

Nozzles 25 are formed in the pressure chamber plate 2 after it has been peeled away.

There is no particular limitation on the method for forming the nozzles 25. The various methods that can be applied include lithography, laser processing, FIB processing, and electrical discharge processing.

The pressure chamber plate 2 fabricated by the processes described above is bonded to the common electrode film 3 to which the reservoir piece 5 has been bonded. The side of the pressure chamber plate 2 on which the nozzles are not formed is bonded to the common electrode film 3 so that the cavities 21 are matched with the respective piezoelectric elements 4.

As based on the first embodiment described in the foregoing, the piezoelectric elements are formed on a first base plate, a pressure chamber plate having a thin thickness is fabricated in a separate process, and the piezoelectric elements and pressure chamber plate are finally bonded together, wherefore ink jet recording heads can be manufactured with good production yield even when the pressure chamber plate is mechanically weak. Accordingly, the pressure chamber plate can be made thinner than conventionally, making it possible to manufacture high-resolution ink jet recording heads.

Second Embodiment

A second embodiment pertains to a manufacturing method for an ink jet recording head wherein piezoelectric elements formed on a base plate are first adhesively joined to another base plate, a pressure chamber plate is next bonded in place, and finally a reservoir piece is bonded in place.

In this second embodiment, the structure of the ink jet recording head that is fabricated is the same as in the first embodiment described in the foregoing, and so is not further described here.

(Ink Jet Recording Head Manufacturing Method)

A manufacturing method for ink jet recording heads according to the present invention is now described with reference to FIGS. 6 and 7. These figures are cross-sectional diagrams of ink jet recording head fabrication processes showing sections cut in the cavity width dimension.

Figure 6A:
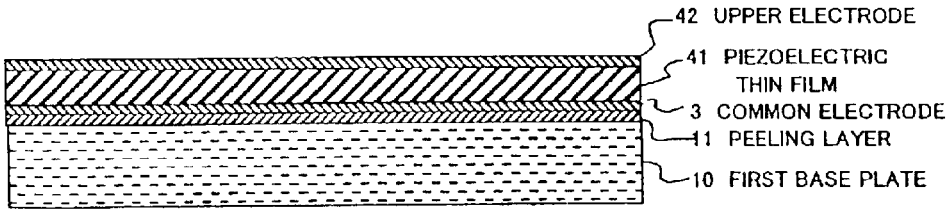
FIG. 6A represents a piezoelectric element formation process, FIG. 6B an etching process, FIG. 6C an adhesive process, and FIG. 6D a first peeling process.
Figure 6B:
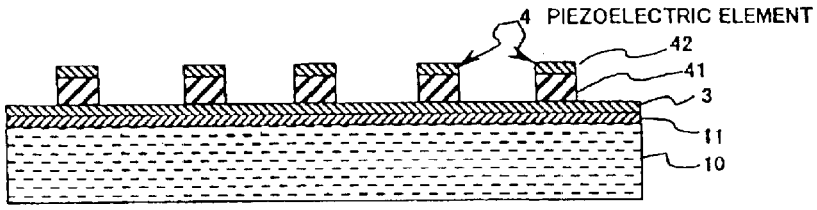

Peeling Layer Formation Process, Common Electrode Film Formation Process, Piezoelectric Element Formation Process (FIG. 6A), and Etching Process (FIG. 6B)

These processes are the same, respectively, as the peeling layer formation process (FIG. 3A), common electrode film formation process (FIG. 6B), piezoelectric element formation process (FIG. 6C), and etching process (FIG. 6D) in the first embodiment described earlier, and so are not further described here.

Figure 6C:
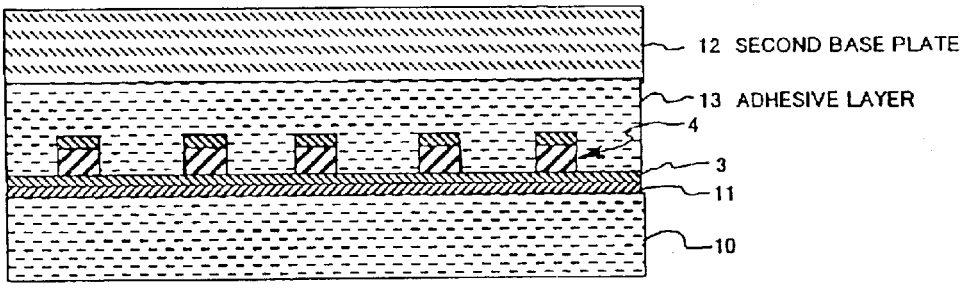
Figure 6D:
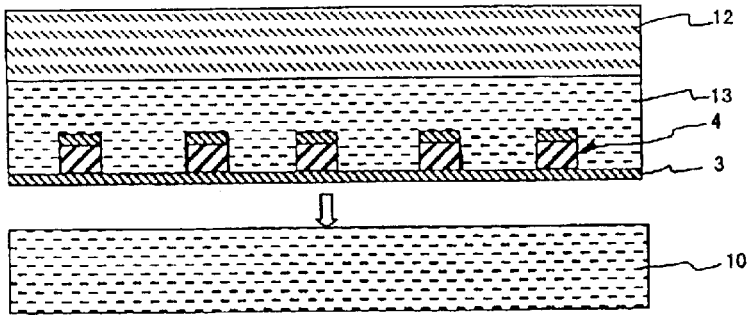

Adhesive Joining Process (FIG. 6C)

The adhesive joining process is a process for adhesively joining a second base plate 12 to the surface of the first base plate 10 on which the piezoelectric elements 4 are formed, using an adhesive agent.

The composition of the second base plate 12 is the same as that of the first base plate 10 in the first embodiment described earlier, and is not further described here.

The adhesive agent used for an adhesive layer 13, in terms of composition, can be any adhesive agent whatsoever, such as an epoxy-, acrylate-, or silicone-based adhesive agent. These adhesive agents are determined according to whether, in a second peeling process, described below, peeling is produced at the interface of the adhesive layer or inside the layer.

In this embodiment, however, it is necessary to produce intra-layer peeling inside the adhesive layer by the application of light, heat, or a combination of both light and heat. For this reason, what is used should either be a thermoplastic resin, or something having a —$CH_2$—, —CO— (ketone), —CONH— (amide), —NH— (imide), —COO— (ester), —N═N— azo), or —CH═N— (cif) bond (which interatomic bonds are severed by the irradiation of light). Or it may be something having in its constituent formula an aromatic hydrocarbon (either one or two or more benzene rings or condensed rings thereof). Specific examples of such organic polymer materials include such polyolefin resins as polyethylenes and polypropylenes, polyimide resins, polyamide resins, polyester resins, acrylic resins, epoxy resins, melamine resins, and phenol resins, etc.

The adhesive layer 13 is formed by a coating method, for example. When a hardening adhesive agent is employed, the hardening adhesive agent is coated onto the surface of the piezoelectric elements 4 that constitute the transfer layer, to which is bonded the second base plate 12. Then, using a hardening method suitable to the properties of that hardening adhesive agent, that hardening adhesive agent is hardened, and the transfer layer and the second base plate 12 are adhesively joined.

When a photo-hardening adhesive agent is employed, the photo-hardening adhesive agent should be coated onto the transfer layer, the light-transmissive second base plate 12 placed on the unhardened adhesive layer, and the hardening light then irradiated from the second base plate side to harden the adhesive agent.

The adhesive layer 13 may also be formed on the second base plate 12 side and the transfer layer adhesively joined thereupon.

Figure 7E:
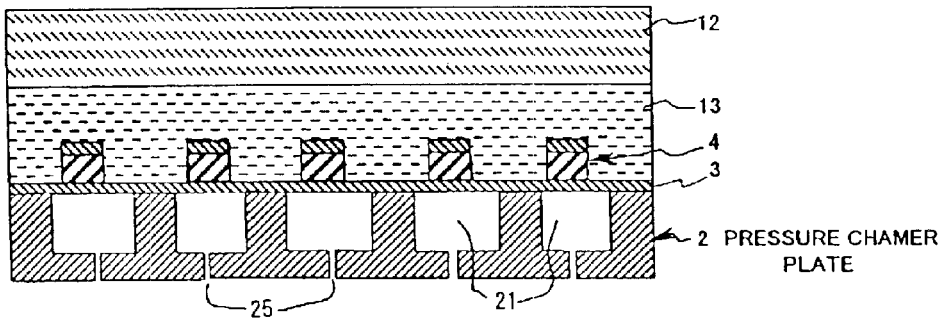
FIG. 7E represents a bonding process, FIG. 7F a second peeling process, FIG. 7G a washing process, and FIG. 7H a reservoir formation process.

First Peeling Process (FIG. 6D) and Bonding Process (FIG. 7E)

The first peeling process and the bonding process are the same as the peeling process (FIG. 4F) and the bonding process (FIG. 4G) in the first embodiment, described earlier, and so are not further described here. The pressure chamber plate 2 fabrication is the same as in the first embodiment also (FIG. 5).

Figure 7F:
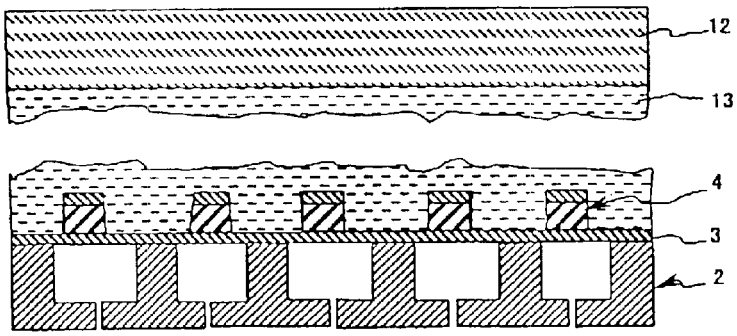
Figure 7G:
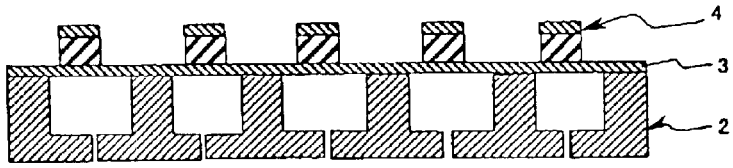

Second Peeling Process (FIG. 7F)

The second peeling process is a process for producing intra-layer peeling in the adhesive layer 13 and thereby peeling the second base plate 12 away from the pressure chamber plate 2.

In this process, peeling is produced in the adhesive layer by subjecting the adhesive layer 13 to prescribed energy. In cases where a thermoplastic resin is employed in the adhesive layer, peeling is produced by applying heat overall so that the transition temperature of the thermoplastic resin is exceeded.

Any adhesive agent left remaining about the periphery of the piezoelectric elements 4 in the intra-layer peeling is removed by a washing process. A solvent is used to remove the adhesive agent which will not adversely affect either the piezoelectric elements or the common electrode film. Examples of solvents that can be used for this purpose include acetone, isopropyl alcohol, ethylene glycol monoethyl ether acetate, propylene glycol monomethyl ether acetate, benzene, xylene, cresol, chlorobenzene, toluene, butyl acetate, normal hexane, cyclohexane, methyl ethyl ketone, dichloromethane, N,N-dimethylformamide, and dimethyl sulfoxide.

Figure 7H:
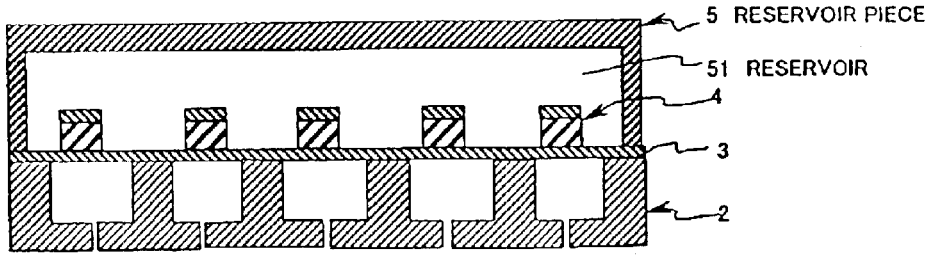

Reservoir Formation Process (FIG. 7H)

The reservoir piece formation process is a process for bonding in place the reservoir piece 5 so that it covers the piezoelectric elements from which the adhesive agent has been removed. The details of this are the same as the reservoir formation process in the first embodiment described earlier (FIG. 4E), and are not reiterated here.

Figure 8:
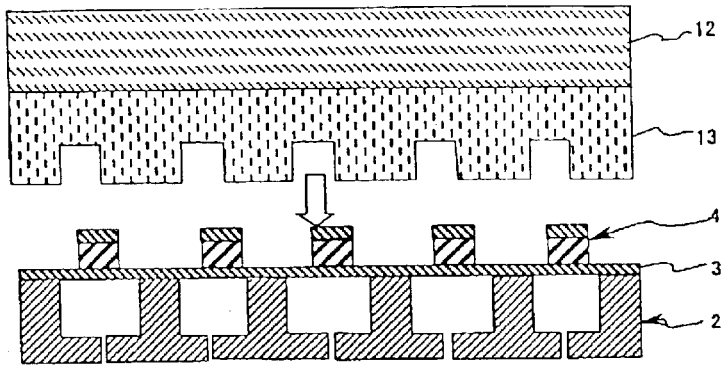
FIG. 8 is a diagram of a modification of the second peeling process.

With this embodiment, it is possible to produce peeling at the interfaces between the adhesive layer 13, and the piezoelectric elements 4 and common electrode film 3, by appropriately selecting the adhesive agent composition and the peeling method. When, for example, an adhesive agent is selected that exhibits greater bonding strength with the second base plate than the bonding strength with the piezoelectric elements 4 and common electrode film 3, as diagrammed in FIG. 8, it is possible to produce peeling from the interfaces between the adhesive layer 13, and the piezoelectric elements 4 and the common electrode film 3. An advantage of producing peeling in this way is that the washing in the washing process can be done easily.

As based on this second embodiment, as described in the foregoing, the piezoelectric elements are formed on a first base plate, this is bonded to a second base plate, and the first base plate is peeled away. A thin pressure chamber plate is fabricated in a separate process, and the piezoelectric elements and pressure chamber plate are finally bonded together, wherefore ink jet recording heads can be manufactured with good production yield even when the pressure chamber plate is mechanically weak. Accordingly, the pressure chamber plate can be formed thinner than conventionally, wherefore it is possible to manufacture high-resolution ink jet recording heads.

As based on this second embodiment, in particular, the piezoelectric elements are fixed by an adhesive layer to a second base plate prior to peeling away the first base plate, wherefore the piezoelectric elements can be handled easily and safely during the manufacturing process.

Third Embodiment

In a third embodiment of the present invention, the adhesive joining process and second peeling process of the second embodiment are modified. The ink jet recording head and the manufacturing method therefor are generally the same as in the embodiments described already. What is different, however, is that an intermediate layer 14 is provided prior to the adhesive joining process (FIG. 6C) described in the foregoing, after which the second base plate 12 is adhesively joined.

Figure 9A:
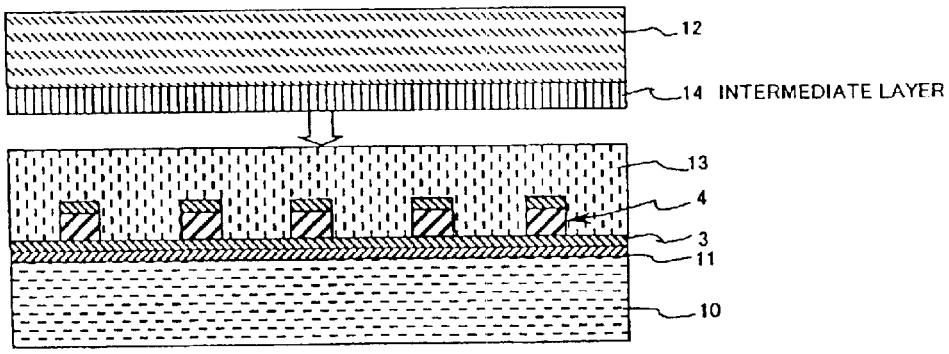
FIG. 9A represents an intermediate layer formation process and adhesion process and FIG. 9B represents a second peeling process.

Modification of Adhesive Joining Process (FIG. 9A)

Before the adhesive joining process, the intermediate layer 14 is formed on the second base plate 12.

The composition of the intermediate layer 14 is a composition wherewith peeling is readily produced at the interface with the adhesive layer 13, that is, a composition exhibiting low bonding strength with the adhesive layer 13.

When an acrylate-based adhesive agent is used in the adhesive layer 13, for example, a composition may be utilized which contains one or more metals selected from among Ni, Cr, Ti, Al, Cu, Ag, Au, and Pt. These metals, in general, exhibit a low bonding strength with acrylate bonding agents, and permit well controlled film formation using a vacuum film forming technique such as sputtering, vapor deposition, or CVD.

The composition used for the intermediate layer 14 may be a composition wherewith peeling can be readily induced, either within the intermediate layer 14, or at the interface between the intermediate layer 14 and the second base plate 12. This may be the same composition as for the peeling layer 11 described already, or it may be porous silicon or alumina or some other anodic oxide film.

Figure 9B:
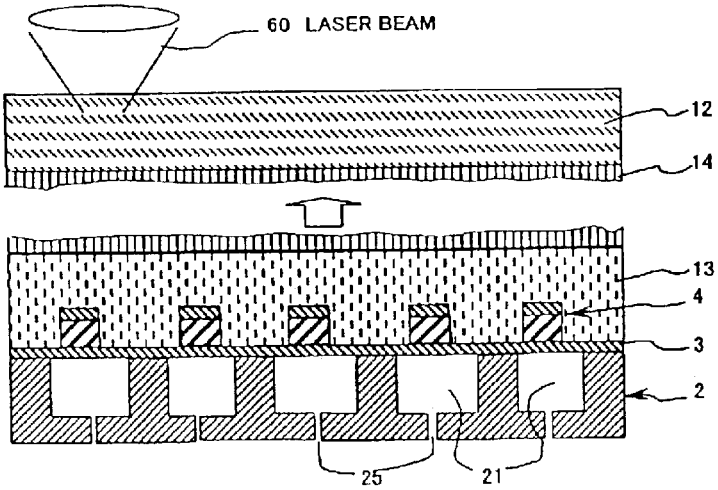

Modification of Second Peeling Process (FIG. 9B)

In order to peel the second base plate 12 away from the adhesive layer 13 in cases where an intermediate layer 14 having the same composition as the peeling layer 11 described in the foregoing is used, peeling is produced by irradiating the intermediate layer 14 with light (laser beam) from the second base plate 12 side, as diagrammed in FIG. 9B.

When porous silicon is used, it is possible, by cutting, to achieve peeling either inside the intermediate layer 14 or at the interface between the intermediate layer 14 and the second base plate 12. When an anodic oxide film is employed, it is possible to produce peeling inside the intermediate layer 14, by cutting, or mechanically, applying an electrical field, and by cutting, for example, either inside the intermediate layer 14 or at the interface between the intermediate layer 14 and the second base plate 12. The adhesive layer 13 left remaining on the pressure chamber plate 2 may be removed by washing, using a solvent treatment or the like.

As based on this third embodiment, as described in the foregoing, an intermediate layer is provided, wherefore peeling can readily be produced between the pressure chamber plate and the second base plate.

Industrial Utilization Possibilities

As based on the present invention, a thin pressure chamber plate is comprised, wherefore ink jet recording heads can be provided which are compatible with higher resolution.

As based on the manufacturing method for ink jet recording heads according to the present invention, a thin pressure chamber plate is formed in a separate process from the piezoelectric elements, wherefore production yield can be improved, and hence costs reduced.

As based on the manufacturing method for ink jet recording heads according to the present invention, a manufacturing method is provided wherewith piezoelectric elements formed in a separate process from the pressure chamber plate are peeled away from the base plate unproblematically, wherefore production yield can be improved, and hence costs reduced.

What is claimed is:

1. A manufacturing method for an ink jet recording head configured so that ink can be discharged from nozzles provided in a plurality of pressure chambers by applying voltage to a plurality of piezoelectric elements to induce volumetric changes therein, comprising:

a peeling layer formation process for forming a peeling layer for producing peeling by irradiation of light onto a first base plate exhibiting light transmissivity;

a common electrode layer formation process for forming a common electrode film on said peeling layer;

a piezoelectric element formation process for forming said plurality of piezoelectric elements on said common electrode film;

an adhesive joining process for adhesively joining a second base plate, through an adhesive layer, to a surface whereon said piezoelectric elements are formed;

a first peeling process for causing peeling in said peeling layer by irradiating said peeling layer from a first base plate side thereof with prescribed light, thereby peeling away said first base plate;

a bonding process for bonding a pressure chamber plate provided with said plurality of pressure chambers onto said common electrode film from which said first base plate has been peeled, so as to seal said pressure chambers; and a second peeling process for peeling away said second base plate.

2. The manufacturing method for an ink jet recording head according to claim 1, wherein said second peeling process produces peeling at interfaces between said adhesive layer, and said piezoelectric elements and said common electrode film.

3. The manufacturing method for an ink jet recording head according to claim 2, wherein said adhesive layer is made so as to contain a substance that can be hardened by application of energy.

4. The manufacturing method for an ink jet recording head according to claim 2, wherein said adhesive layer is made of a thermoplastic resin.

5. The manufacturing method for an ink jet recording head according to claim 1, wherein said second peeling process produces peeling inside said adhesive layer.

6. The manufacturing method for an ink jet recording head according to claim 1, further comprising an intermediate layer formation process for forming an intermediate layer between said adhesive layer and said second base plate.

7. The manufacturing method for an ink jet recording head according to claim 6, wherein said intermediate layer is made so as to contain one or more metals selected from the group consisting Ni, Cr, Ti Al, Cu, Ag, Au, and Pt, and, in said second peeling process, peeling is produced at interface between relevant intermediate layer and said adhesive layer.

8. The manufacturing method for an ink jet recording head according to claim 6, wherein said intermediate layer is constituted either by porous silicon or an anodic oxide film, and, in said second peeling process, peeling is produced either inside relevant intermediate layer or at interface between relevant intermediate layer and said second base plate.

9. The manufacturing method for an ink jet recording head according to claim 6, wherein said intermediate layer is formed using a material selected from the group consisting of amorphous silicon, a ceramic oxide, a ceramic nitride, an organic polymer, and a metal, and, in said second peeling process, peeling is produced in relevant intermediate layer by irradiating said intermediate layer from said second base plate side with prescribed light.

* * * * *